US006593900B1

(12) United States Patent
Craven et al.

(10) Patent No.: US 6,593,900 B1
(45) Date of Patent: Jul. 15, 2003

(54) FLEXIBLE PRINTED CIRCUIT BOARD ANTENNA

(75) Inventors: Robert P. M. Craven, Cookeville, TN (US); James E. Smith, Bruceton Mills, WV (US); Joffre J. Rolland, Jr., Clarksburg, WV (US)

(73) Assignee: West Virginia University, Morgantown, WV (US)

( * ) Notice: Subject to any disclaimer, the term of this patent is extended or adjusted under 35 U.S.C. 154(b) by 0 days.

(21) Appl. No.: 10/087,911

(22) Filed: Mar. 4, 2002

(51) Int. Cl.[7] ..... H01Q 1/38
(52) U.S. Cl. ..... 343/895; 343/742
(58) Field of Search ..... 343/895, 741, 343/742, 866, 867, 795

(56) References Cited

U.S. PATENT DOCUMENTS

| | | | |
|---|---|---|---|
| 3,284,801 | A | 11/1966 | Bryant |
| 3,646,562 | A | 2/1972 | Acker et al. |
| 3,671,970 | A | 6/1972 | Layton |
| 3,721,989 | A | 3/1973 | Christensen |
| 4,622,558 | A | 11/1986 | Corum |
| 4,751,515 | A | 6/1988 | Corum |
| 4,999,642 | A | 3/1991 | Wells |
| 5,159,332 | A | 10/1992 | Walton |
| 5,173,715 | A | 12/1992 | Rodal et al. |
| 5,257,033 | A | 10/1993 | Roche |
| 5,442,369 | A | 8/1995 | Van Voorhies et al. |
| 5,521,610 | A | 5/1996 | Rodal |
| 5,646,635 | A | 7/1997 | Cockson et al. |
| 5,654,723 | A | 8/1997 | Craven et al. |
| 5,709,832 | A | 1/1998 | Hayes et al. |
| 5,734,353 | A | 3/1998 | Van Voorhies |
| 5,952,978 | A | 9/1999 | Van Voorhies |
| 6,028,558 | A | 2/2000 | Van Voorhies |
| 6,069,592 | A | 5/2000 | Wass |
| 6,111,549 | A | 8/2000 | Feller |
| 6,204,821 | B1 | 3/2001 | Van Voorhies |
| 6,218,998 | B1 | 4/2001 | Van Voorhies |
| 6,239,760 | B1 | 5/2001 | Van Voorhies |
| 6,300,920 | B1 | 10/2001 | Pertl et al. |
| 6,304,231 | B1 | 10/2001 | Reed et al. |
| 6,320,550 | B1 | 11/2001 | Van Voorhies |

FOREIGN PATENT DOCUMENTS

| | | |
|---|---|---|
| DE | 3823972 A1 | 1/1990 |
| EP | 043591 A1 | 1/1982 |
| JP | 7146386 | 6/1995 |

OTHER PUBLICATIONS

J.M. Ham, et al., "Time–Varying Electric and Magnetic Fields," Scientific Basis of Electrical Engineering, pp. 302–305, 1961.

Howard W. Sams, Reference Data for Radio Engineers, 7th Ed. E.C. Jordan Ed., pp. 6–13–6–14.

(List continued on next page.)

*Primary Examiner*—Michael C. Wimer
(74) *Attorney, Agent, or Firm*—Kirk D. Houser; Eckert Seamans Cherin & Mellott, LLC

(57) ABSTRACT

An electromagnetic antenna for a non-planar surface includes a flexible printed circuit board having three or four conductive levels. The flexible printed circuit board is adapted to conform to the non-planar surface and includes a plurality of electrical connections between the conductive levels and a plurality of electrical traces on the conductive levels. The electrical connections and the electrical traces form a first helix having a first helical pitch sense from a first node to a second node, and also form a second helix having a second helical pitch sense, which is opposite from the first helical pitch sense, from a third node to a fourth node. The first and second helices are contrawound relative to each other. First and second signal terminals are provided and are electrically connected with at least one of the nodes.

38 Claims, 12 Drawing Sheets

OTHER PUBLICATIONS

Kandoian, A.G., et al., "Wide Frequency–Range Tuned Helical Antennas and and Circuits," Fed. Telecommunication Laboratories, Inc., pp. 42–47, 1953.

Birdsall, C.K., et al., "Modified Contra–Wound Helix Circuits for High–Power Traveling–Wave Tubes," IRE Transactions on Electron Devices, pp. 190–206, Oct. 1956.

Harington, R.F., "Time Harmonic Electromagnetic Fields," pp. 106–111, 1961.

Van Voorhies, K.L., et al., "Energy and The Environment: A Continuing Partnership," 26th Intersociety Energy Conversion Engineering Conference, 6 pp., Aug. 1991.

Ben Smith, "CTHA Evaluation," http://www.antennex.com, pp. 1–11, Feb. 23, 2000.

FLEXIBLE PRINTED CIRCUIT BOARD ANTENNA

BACKGROUND OF THE INVENTION

1. Field of the Invention

This invention relates to transmitting and receiving antennas, and, in particular, to antennas employing contrawound windings.

2. Background Information

U.S. Pat. Nos. 5,442,369; and 6,028,558, which are incorporated by reference herein, disclose Contrawound Toroidal Helical Antennas (CTHAs). See, also, U.S. Pat. Nos. 5,734,353; 5,952,978; 6,204,821; 6,218,998; 6,239,760; and 6,300,920.

A CTHA employs a toroid or other multiply connected surface and a pair of contrawound helical conductors wrapped upon such surface as a construction aid. Rectangular cross-section CTHAs may be employed. CTHAs having printed circuit conductors may also be employed, as well as a CTHA in the form of a conventional rigid dielectric printed circuit board (PCB).

Referring to FIG. 1, one type of CTHA 2, for example, employs a toroidal surface and two contrawound helical windings 4,6, which are fed with opposite currents in order that the magnetic flux of each helix reinforces the loop magnetic flux.

U.S. Pat. Nos. 4,622,558; and 4,751,515 discuss certain aspects of toroidal antennas as a technique for creating a compact antenna by replacing the conventional linear antenna with a self resonant toroidal structure that produces vertically polarized radiation that will propagate with lower losses when propagating over the earth. These patents initially discuss a monofilar toroidal helix as a building block for more complex directional antennas. Those antennas may include multiple conducting paths fed with signals whose relative phase is controlled either with external passive circuits or due to specific self resonant characteristics. In a general sense, the patents discuss the use of so called contrawound toroidal windings to provide multiple polarization.

U.S. Pat. No. 5,654,723 discloses antennas having various geometric shapes, such as a sphere. For example, if a sphere is small with respect to wavelength, then the current distribution is uniform. This provides the benefit of a spherical radiation pattern, which approaches the radiation pattern of an ideal isotropic radiator or point source, in order to project energy equally in all directions. Other geometric shapes may provide similar benefits. Contrawound windings are employed to cancel electric fields and leave a magnetic loop current. Thus, different modes of operation of CTHAs may be induced by varying the antennas' geometric properties.

U.S. Pat. No. 5,709,832 discloses a printed monopole antenna including a PCB having a conductive trace formed on one side thereof.

U.S. Pat. No. 6,304,231 discloses an antenna embedded in a flexible circuit, which is mounted with adhesive on a planar member.

U.S. Pat. Nos. 5,173,715; and 5,521,610 disclose a flexible circuit comprising a pair of printed circuit antenna elements and a set of four printed circuit anchors, which are all disposed on one side of an insulating substrate. The proximity of the ends of the antenna elements to respective grounded anchors is such that some capacitive loading results. Preferably, such capacitive loading is, controlled and evenly matched in order to obtain an optimum hemispheric reception pattern. The antenna elements form orthogonal dipole antennas that are slightly shorter than one-quarter wavelength at the GPS L1 carrier frequency. See, also, U.S. Pat. No. 6,111,549.

U.S. Pat. No. 5,646,635 discloses an antenna including a non-conductive sheath or covering, which encloses an upper radiator of a radiator. That PCB radiator also includes a lower radiator, which is received by an elongated slot of a housing member. Both the upper and lower PCB radiators have conductive serpentine traces provided thereon in conventional fashion. The PCB radiators are flexible and are preferably comprised of a metallic conductor attached to a flexible substrate, for example, a copper conducting trace on a flexible polyamide substrate forming a common flexible circuitry material. The serpentine trace is selected to provide the options of inductance, capacitance and distributed capacity between traces in order to provide optimal matched conditions to the circuitry to which it is attached.

U.S. Pat. No. 6,069,592 discloses a cylindrical configuration into which a meander element and a flexible film carrier are shaped together. Alternatively, the flexible film carrier could be exchanged for another dielectric carrier, preferably having a cylindrical shape with some suitable cross-section, on which a meander conductor may also be applied or developed by a high precision technique, for example etching. Alternatively, two individual meander elements each have their own feed point to be coupled individually to circuitry of a telephone, possibly via an impedance matching circuit.

U.S. Pat. No. 6,320,550 discloses a Contrawound Helical Antenna.

There is room for improvement in transmitting and receiving contrawound antennas.

SUMMARY OF THE INVENTION

These and other needs are met by the present invention in which an electromagnetic antenna employs first and second contrawound helices on a flexible printed circuit board.

As one aspect of the invention, an electromagnetic antenna for a non-planar surface comprises: a flexible printed circuit board having at least three conductive levels, the flexible printed circuit board being adapted to conform to the non-planar surface, the flexible printed circuit board including a plurality of electrical connections between the conductive levels and a plurality of electrical traces on the conductive levels, the electrical connections and the electrical traces forming a first helix having a first helical pitch sense from a first node to a second node, and also forming a second helix having a second helical pitch sense, which is opposite from the first helical pitch sense, from a third node to a fourth node, the first and second helices being contrawound relative to each other; first and second signal terminals; and means for electrically connecting the signal terminals with at least one of the nodes.

The first node may be electrically connected to the fourth node and the second node may be electrically connected to the third node in order that the first and second helices form a single endless conductive path; and the means for electrically connecting may include a first electrical connection from the first signal terminal to the first node, and a second electrical connection from the second signal terminal to the third node.

The first node may be electrically connected to the second node and the third node may be electrically connected to the fourth node in order that the first and second helices form two endless conductive paths; and the means for electrically connecting may include a first electrical connection from the first signal terminal to the first node, and a second electrical connection from the second signal terminal to the third node.

The flexible printed circuit board may be adapted to conform to a surface of an aircraft, a vehicle, a water vessel, or an arcuate surface as the non-planar surface.

The flexible printed circuit board may be adapted for attachment to the non-planar surface, for partial wrapping about a closed surface as the non-planar surface, or for complete wrapping about a closed surface as the non-planar surface.

As another aspect of the invention, an electromagnetic antenna comprises: a flexible printed circuit board having at least three conductive levels, a first end and a second end, the first end being positioned proximate the second end to form a non-planar surface, the flexible printed circuit board including a plurality of electrical connections between the conductive levels and a plurality of electrical traces on the conductive levels, the electrical connections and the electrical traces forming a first helix having a first helical pitch sense from a first node to a second node, and also forming a second helix having a second helical pitch sense, which is opposite from the first helical pitch sense, from a third node to a fourth node, the first and second helices being contrawound relative to each other; first and second signal terminals; and means for electrically connecting the signal terminals with at least one of the nodes.

The first node may be electrically connected to the fourth node and the second node may be electrically connected to the third node in order that the first and second helices form a single endless conductive path; and the means for electrically connecting may include a first electrical connection from the first signal terminal to the first node, and a second electrical connection from the second signal terminal to the third node.

The first node may be electrically connected to the second node and the third node may be electrically connected to the fourth node in order that the first and second helices form two endless conductive paths; and the means for electrically connecting may include a first electrical connection from the first signal terminal to the first node, and a second electrical connection from the second signal terminal to the third node.

The non-planar surface may be a cylinder.

As another aspect of the invention, an electromagnetic antenna for a non-planar surface comprises: a flexible printed circuit board having at least three conductive levels, the flexible printed circuit board being adapted to conform to the non-planar surface, the flexible printed circuit board including a plurality of electrical connections between the conductive levels and a plurality of electrical traces on the conductive levels, the electrical connections and the electrical traces forming a first helix having a first helical pitch sense from a first node to a second node, and also forming a second helix having a second helical pitch sense, which is opposite from the first helical pitch sense, from a third node to a fourth node, the first and second helices being contrawound relative to each other; first and second signal terminals structured for transmitting or receiving an antenna signal; and means for electrically coupling the antenna signal to or from the first and second helices.

As another aspect of the invention, an electromagnetic antenna comprises: a flexible printed circuit board having at least three conductive levels, a first end and a second end, the first end being positioned proximate the second end to form a non-planar surface, the flexible printed circuit board including a plurality of electrical connections between the conductive levels and a plurality of electrical traces on the conductive levels, the electrical connections and the electrical traces forming a first helix having a first helical pitch sense from a first node to a second node, and also forming a second helix having a second helical pitch sense, which is opposite from the first helical pitch sense, from a third node to a fourth node, the first and second helices being contrawound relative to each other; first and second signal terminals structured for transmitting or receiving an antenna signal; and means for electrically coupling the antenna signal to or from the first and second helices.

BRIEF DESCRIPTION OF THE DRAWINGS

A full understanding of the invention can be gained from the following descrption of the preferred embodiments when read in conjunction with the accompanying drawings in which.

DESCRIPTION OF THE PREFERRED EMBODIMENTS

As employed herein, the term "multiply connected surface" shall expressly include, but not be limited to: (a) any toroidal surface, such as a preferred toroid form having its major radius greater than or equal to its minor radius, or a toroid form having its major radius less than its minor radius (see, for example, U.S. Pat. No. 5,654,723); (b) other surfaces formed by rotating and transforming a plane closed curve or polygon having a plurality of different radii about an axis lying on its plane; and (c) still other surfaces, such as surfaces like those of a washer or nut, such as a hex nut, formed from a generally planar material in order to define, with respect to its plane, an inside circumference greater than zero and an outside circumference greater than zero, with the outside and inside circumferences being either a plane closed curve and/or a polygon. Furthermore, such multiply connected surfaces may include surfaces formed by an air core or formed on parallel levels of a printed circuit board antenna, such as a PCBCTHA.

A CTHA may have multiple sections, each with a potentially different feed, as in the four sections of the Quad-Contra configuration disclosed in U.S. Pat. No. 5,442,369. For simplicity of disclosure, the following description is with regard to a single contrawound toroidal section, although a plurality of such sections may be employed to increase the possible feed configurations.

A single section CTHA has four wire ends, each of which may be: (1) left alone; (2) electrically connected to another wire end; and/or (3) electrically connected to one of two transmitter and/or receiver feed lines. Conversely, each of those two feed lines from the transmitter and/or receiver may be: (1) electrically connected to a wire end; (2) electrically connected to a group of wire ends; (3) electrically connected to something completely different (e.g., a ground plane, reflector, inductively coupled loop); or (4) left unconnected (i.e., including suitable signal coupling without any electrical connections).

Figure 2A:
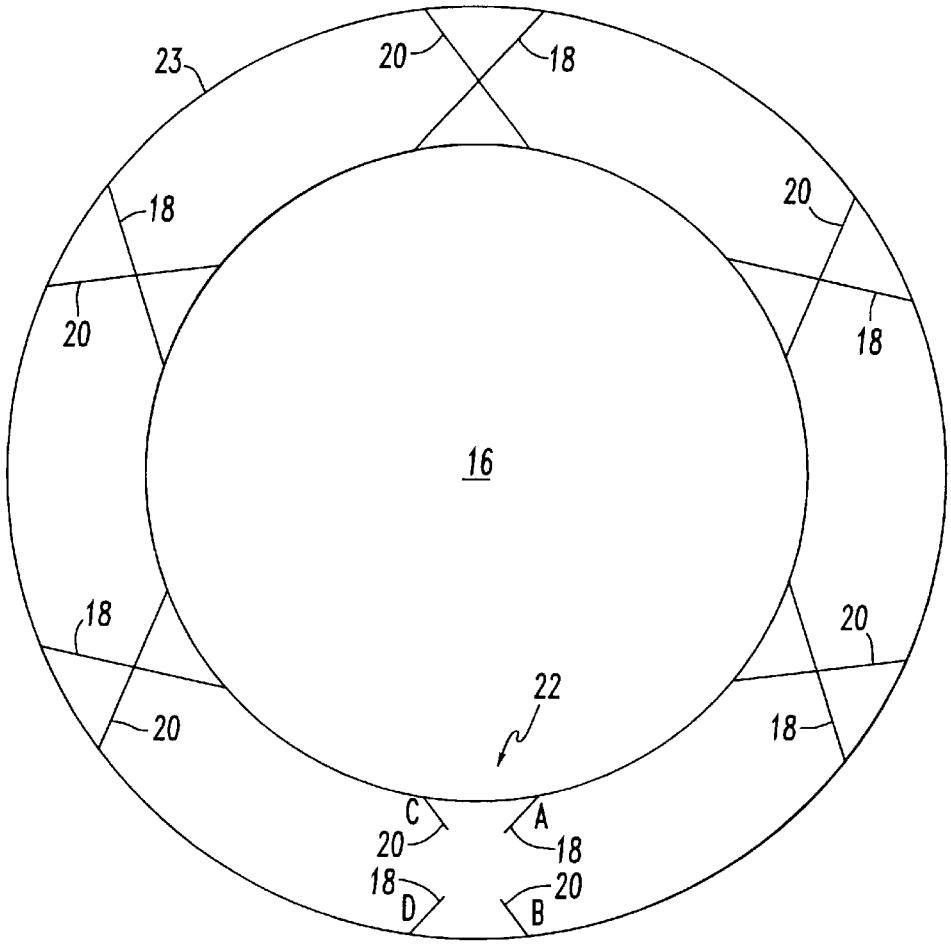
FIG.2A PRIOR ART
FIGS. 2A and 2B are wiring diagrams for CTHAs having polar and equatorial crossings, respectively.
Figure 2B:
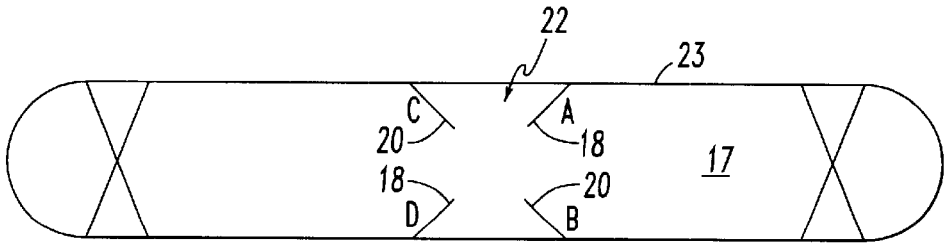
FIG.2B PRIOR ART

FIGS. 2A–2B show wire ends A,B,C,D for two different CTHA antennas 16,17. The CTHA antenna 16 of FIG. 2A has "polar" crossings at the top and the bottom (only the crossings at the top of the antenna 16 are shown) thereof, while the CTHA antenna 17 of FIG. 2B, which is shown in profile, has equatorial crossings at the outside and the inside (only the crossings at the outside of the antenna 17 are shown) thereof. In either case, two conductors 18,20 are employed with both ends in the feed area 22. The conductor 18 has ends A,D, while the conductor 20 has ends B,C.

The conductors 18,20 are insulated conductors. The first insulated conductor, such as 18, extends around and over a multiply connected surface, such as the exemplary toroidal surface 23, with a first pitch or winding sense (e.g., a right-handed winding sense) from the node A to the node D. The second insulated conductor, such as 20, extends around and over the exemplary surface 23, with a second pitch or winding sense (e.g., a left-handed winding sense) from the node B to the node C. The first and second pitch or winding senses are opposite, in order that the conductors 18,20 are contrawound relative to each other around and over the surface 23.

Figure 1:
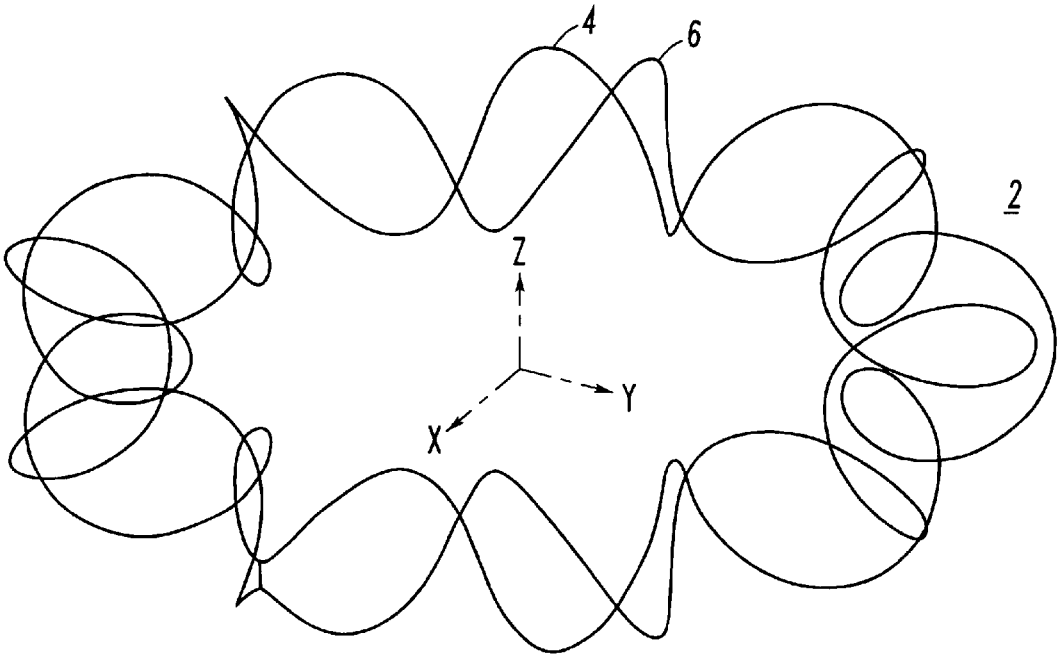
FIG. 1 PRIOR ART
FIG. 1 is an isometric view of two helical windings in a Contrawound Toroidal Helical Antenna (CTHA) structure.
Figure 3A:
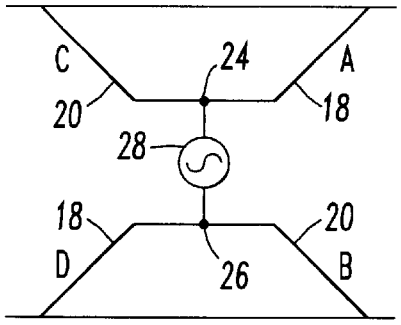
FIG. 3A PRIOR ART
FIGS. 3A and 3B are views of two CTHA feeds, which employ two feed lines.
Figure 3B:
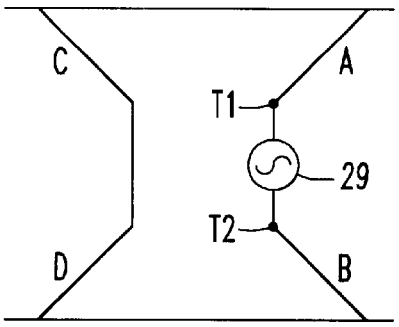
FIG. 3B PRIOR ART

As disclosed, for example, in U.S. Pat. No. 6,028,558, and as shown in FIG. 3A, ends or nodes A and C are suitably electrically connected together with one electrical connection 24, and ends or nodes B and D are suitably electrically connected together with another electrical connection 26. This configuration imparts contra-currents on the two contrawound helices formed by the conductors 18,20. Those currents, in turn, add together to form a pseudo-poloidal current, thereby reinforcing the loop magnetic flux. This arrangement is advantageous for producing vertically polarized energy from a predominately horizontal structure. In turn, those electrical connections 24,26 form respective "signal terminals", which are structured for transmitting or receiving an antenna signal 28. Another prior CTHA feed arrangement is shown in FIG. 3B, in which the nodes D and C are electrically connected, and the nodes A and B are electrically connected to respective signal terminals T1 and T2 for transmitting or receiving an antenna signal 29.

While "terminals" are not an essential part of CTHA antennas, terminals are employed herein as a mechanism for logically describing connections. In this regard, four terminal designations are employed: terminals #1 and #2 represent two feed lines, and terminals #3 and #4 represent a mechanism for connecting multiple wire ends, which are not fed. In defining the various feed arrangements which are disclosed herein, each of the four wire ends A,B,C,D can, therefore, have five possible values: the value "0" means no connection, while the values "1," "2," "3," and "4" indicate a terminal connection.

The following six rules (R1–R6) are employed in defining connections herein: (R1) if terminal #3 or #4 has a wire electrically connected to it, then it either has more than one wire electrically connected to it, or it is redundant to a configuration having no connection; (R2) terminals #3 and #4 are interchangeable (i.e., there is no logical difference); (R3) terminals #1 and #2 are interchangeable (i.e., there is no logical difference); (R4) wire ends A and B may be swapped for ends C and D, respectively (i.e., there is A⇆C and B⇆D symmetry); (R5) wire ends A and D may be swapped for ends B and C, respectively (i.e., there is A⇆B and C⇆D symmetry); and (R6) wire ends A and B may be swapped for D and C, respectively (i.e., there is A⇆D and B⇆C symmetry). Rule 6 is the same as performing rule 4 followed by rule 5. These rules are employed to remove redundant and symmetrical configurations. While this procedure is not the only method for determining all possible configurations, it is sufficiently rigorous to ensure that all configurations are identified. Also, combinations of these symmetry rules are employed to remove all redundant configurations.

Table 1 shows the effect of removing redundant feed configurations by applying successive symmetry rules. There are, thus, 35 physical ways to connect a pair of feed lines to the four wire ends A,B,C,D. In turn, these may be diversified by employing multiple segment CTHAs, or by employing, for example, inductive loops, reflectors, or ground planes, in combination with the various feed configurations.

TABLE 1

| Operation | Combinations |
|---|---|
| 4 wire ends with 5 possible values | 625 |
| Rule 1 (R1) | 221 |
| Rule 2, Rule 3, and Rule 2 then Rule 3 (R2, R3, R2-R3) | 83 |
| R4, R4-R2, R4-R3, R4-R2-R3 | 51 |
| R5, R5-R2, R5-R3, R5-R2-R3 | 46 |
| R6, R6-R2, R6-R3, R6-R2-R3 | 35 |

Table 2 defines wire end terminal connections for various CTHA feeds and divides the 35 exemplary feed configurations of Table 1 into three main groups: (1) two connection feeds; (2) one connection feeds; and (3) no physical connection feeds. The third category employs alternative feed techniques (e.g., inductive loops, reflectors, ground planes, multiple antennas, antenna coupling of passive elements in an array).

TABLE 2

| Feed # | Wire A | Wire B | Wire C | Wire D |
|---|---|---|---|---|
| | Two Connections | | | |
| 1 | 3 | 2 | 3 | 1 |
| 2 | 1 | 0 | 0 | 1 |
| 3 | 0 | 1 | 0 | 2 |
| 4 | 2 | 1 | 0 | 0 |
| 5 | 1 | 2 | 3 | 3 |
| 6 | 2 | 1 | 2 | 1 |
| 7 | 2 | 2 | 1 | 1 |
| 8 | 2 | 3 | 3 | 1 |
| 9 | 1 | 2 | 2 | 1 |
| 10 | 2 | 2 | 0 | 1 |
| 11 | 2 | 1 | 0 | 1 |
| 12 | 1 | 2 | 0 | 2 |
| 13 | 2 | 1 | 1 | 1 |
| | One Connection | | | |
| 14 | 1 | 0 | 0 | 0 |
| 15 | 1 | 1 | 0 | 0 |
| 16 | 1 | 0 | 1 | 0 |
| 17 | 0 | 1 | 1 | 0 |
| 18 | 1 | 1 | 1 | 0 |
| 19 | 3 | 3 | 1 | 0 |
| 20 | 3 | 1 | 3 | 0 |
| 21 | 1 | 3 | 3 | 0 |
| 22 | 1 | 1 | 1 | 1 |
| 23 | 3 | 3 | 1 | 1 |
| 24 | 3 | 1 | 3 | 1 |
| 25 | 1 | 3 | 3 | 1 |
| 26 | 3 | 3 | 3 | 1 |
| | No Connections | | | |
| 27 | 0 | 0 | 0 | 0 |
| 28 | 3 | 3 | 0 | 0 |
| 29 | 3 | 0 | 3 | 0 |
| 30 | 0 | 3 | 3 | 0 |
| 31 | 3 | 3 | 3 | 0 |
| 32 | 3 | 3 | 3 | 3 |
| 33 | 4 | 4 | 3 | 3 |
| 34 | 4 | 3 | 4 | 3 |
| 35 | 3 | 4 | 4 | 3 |

The resonance properties of a Printed Circuit Board Contrawound Toroidal Helical Antenna (PCBCTHA) can be varied to meet the needs of specific communication applications.

Figure 4:
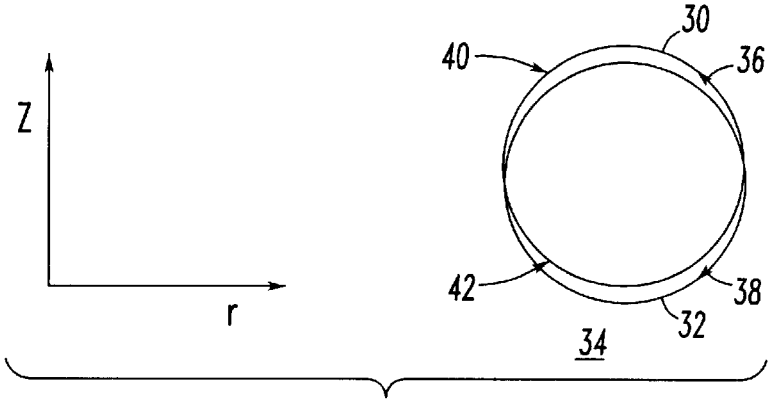
FIG. 4 is a cylindrical coordinate two-dimensional representation of two toroidal helices.

Considering a toroidal helix in terms of cylindrical coordinates r, θ and z will provide insight into crossover considerations of PCBCTHAs. Cylindrical coordinates include a vertical direction, z, similar to the height, z, of the classical x, y, z Cartesian coordinate system. Cylindrical coordinates replace the two classical directions x and y with an angle about z, θ, and a radial distance from the z-axis, r. FIG. 4 shows each of the two toroidal helices 30,32 of a CTHA 34 presented on an r-z plot wherein the angular direction θ, has been straightened and proceeds into the paper. The arrows 36,38 indicate the winding direction of the conductor for increasing values of θ. Although the CTHA 34 includes circular cross-section helices 32,34, a wide range of other cross-sections may be employed.

The actual construction of a CTHA either employs two helices being slightly offset in the r-z plane or a regular shape is "bulged" (not shown) in the vicinity of crossovers 40,42, in order to prevent the two conductors from making electrical connection. Similarly, printed circuit board versions of the CTHA (FIGS. 6–12, 14 and 16) account for the three-dimensional nature of the crossovers of two contrawindings.

The crossovers 40,42 of the two contrawound helices 30,32 prohibit the use of a single double-sided printed circuit board for the construction of PCBCTHAs. It is possible with a single double-sided board to create a single toroidal helix or even two toroidal helices that share the same chirality (handedness), but not contrawindings.

Figure 5:
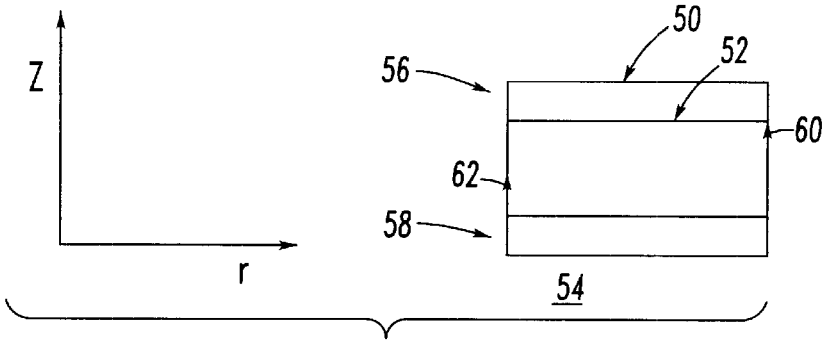
FIG. 5 is a cylindrical coordinate two-dimensional representation of two rectangular cross-section toroidal helices.

FIG. 5 shows a similar representation of two contrawound helices 50,52 of a CTHA 54 that have rectangular cross-sections and crossovers 56,58. The arrows 60,62 indicate the winding direction of the conductor for increasing values of θ. The vertical displacement of the helices 50,52 is not the only direction that works for general CTHAs, although it is preferred for printed circuit board versions.

A four-layer printed circuit board 70 (FIG. 8) may be employed to achieve two contrawindings. This can be achieved in numerous manners, although two double-sided boards 72,74 with a spacer board 76 therebetween is one preferred embodiment. Preferably, the thickness of the spacer board 76 (e.g., without limitation, greater than or equal to the thickness of the double-sided boards) is significantly thicker than the thickness (e.g., without limitation, about 0.031 in., about 0.062 in.) of each of the two PCBs 72,74, in order that the overall aspect ratio approaches rectangular (i.e., that the overall shape of the loop in the winding is about the same on all four sides).

Figure 6:
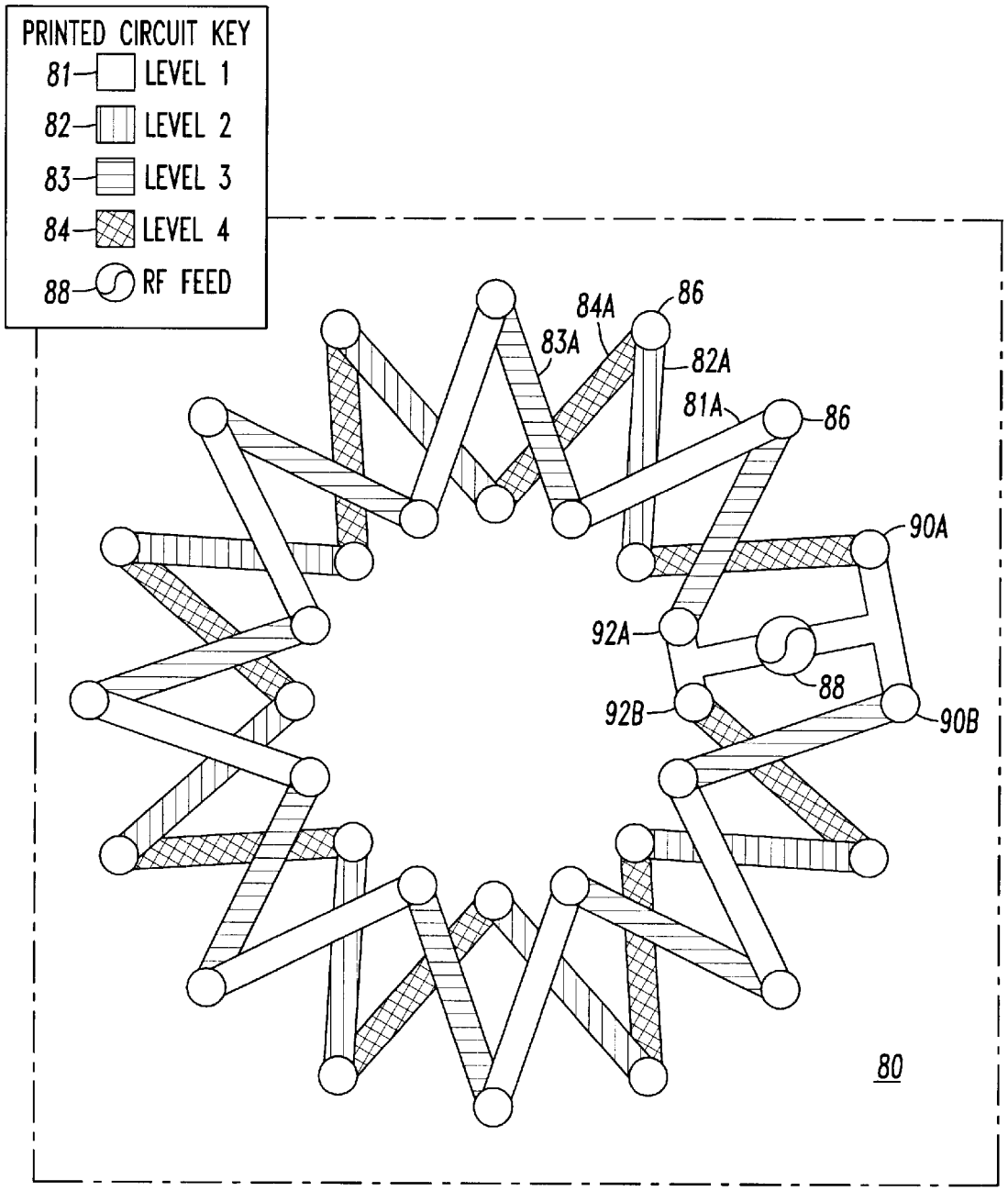
FIG. 6 PRIOR ART
FIG. 6 shows a printed circuit board CTHA (PCBCTHA).

The PCBCTHA 54 of FIG. 5 can be more easily understood by examining the r-θ plane cut as shown in FIG. 6. The PCBCTHA 80 has four circuit board levels 81,82,83,84, which levels are represented by different patterns in FIGS. 6, 9–12 and 14. The vertical sections between the levels 81,82,83,84 are shown as circles 86, which represent the through holes between two or more of the PCB levels 81,82,83,84. The conductive traces 81A,82A,83A,84A (on respective levels 81,82,83,84) and the holes 86 all represent conductive surfaces to complete electrical connections in the form of toroidal helices. The holes 86 can be either plug filled (i.e., plated and conductively filled such as, for example, with solder) or plated and not conductively filled depending on the needs of the application and the capabilities of the manufacturing process. The RF feed 88 (e.g., which employs the feed connection shown in FIG. 3A) is between signals terminals 90A–90B and 92A–92B, although a wide range of feed connections may also be employed as discussed, above, in connection with Table 2.

Figure 9:
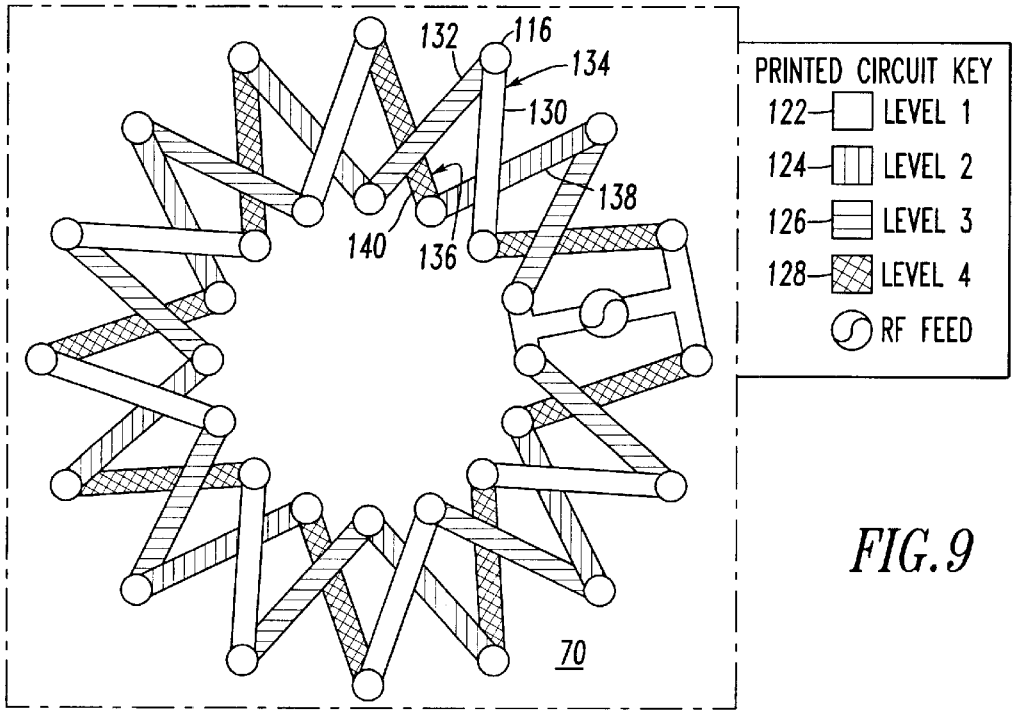
FIG. 9 is a plan view of a woven helix PCBCTHA.
Figure 21:
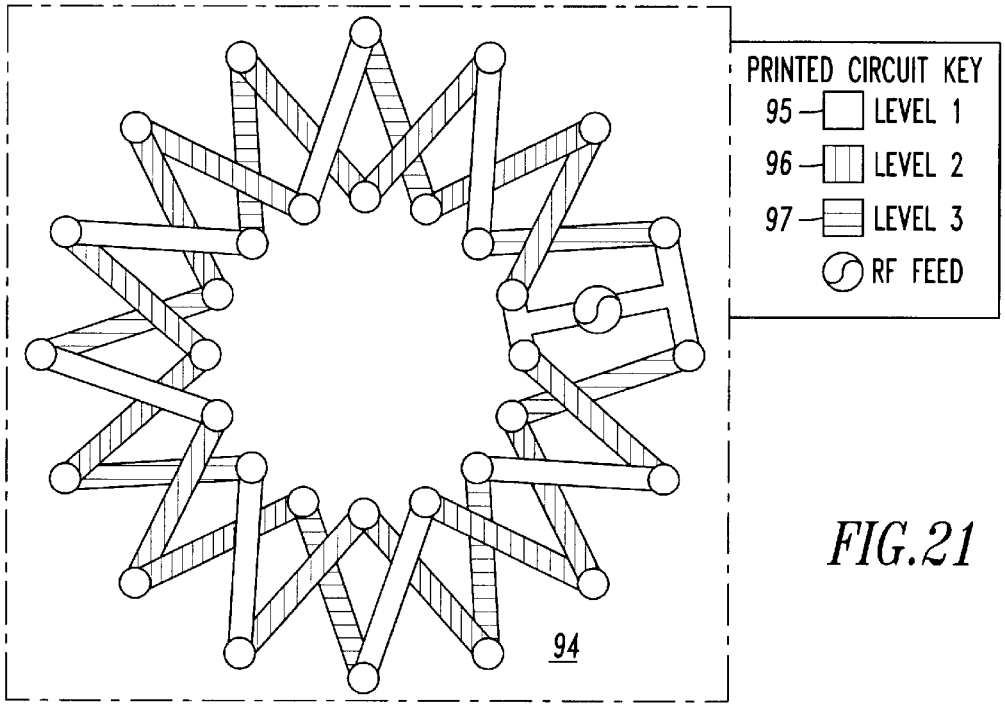
FIG. 21 shows a PCBCTHA, which is similar to the PCBCTHA of FIG. 6, except that it has three conductive levels.

Although FIG. 9, for example, shows the PCBCTHA 70 having four conductive levels 122,124,126,128, three, five, or more of such levels may be employed. For example, level 124 (level 2) and level 126 (level 3) may be combined on a single level. FIG. 21 shows such a PCBCTHA 94, which is similar to the PCBCTHA 70, except that it has three conductive levels including level 95 (level 1), level 96 (level 2) and level 97 (level 3). In this example, if the PCBCTHA 94 is constructed from a four-level PCB material (not shown), then the fourth level may be left unused, may be dedicated to a ground plane, or may be dedicated to another electrical circuit or mechanical function.

As another alternative to the four-level PCBCTHA 70 of FIG. 9, level 122 (level 1) and level 128 (level 4) may be combined (not shown) on a single level. Again, if a four-level PCB material (not shown) is employed, then the unused level (e.g., level 1 or level 4) may be left unused, may be dedicated to a ground plane, or may be dedicated to another electrical circuit or mechanical function.

Although it would be physically possible to combine level 124 (level 2) and level 126 (level 3) of PCBCTHA 70 on one level, and level 122 (level 1) and level 128 (level 4) on another level of a two-level PCB (not shown), it is believed that such a structure would not function as a CTHA.

Figure 7:
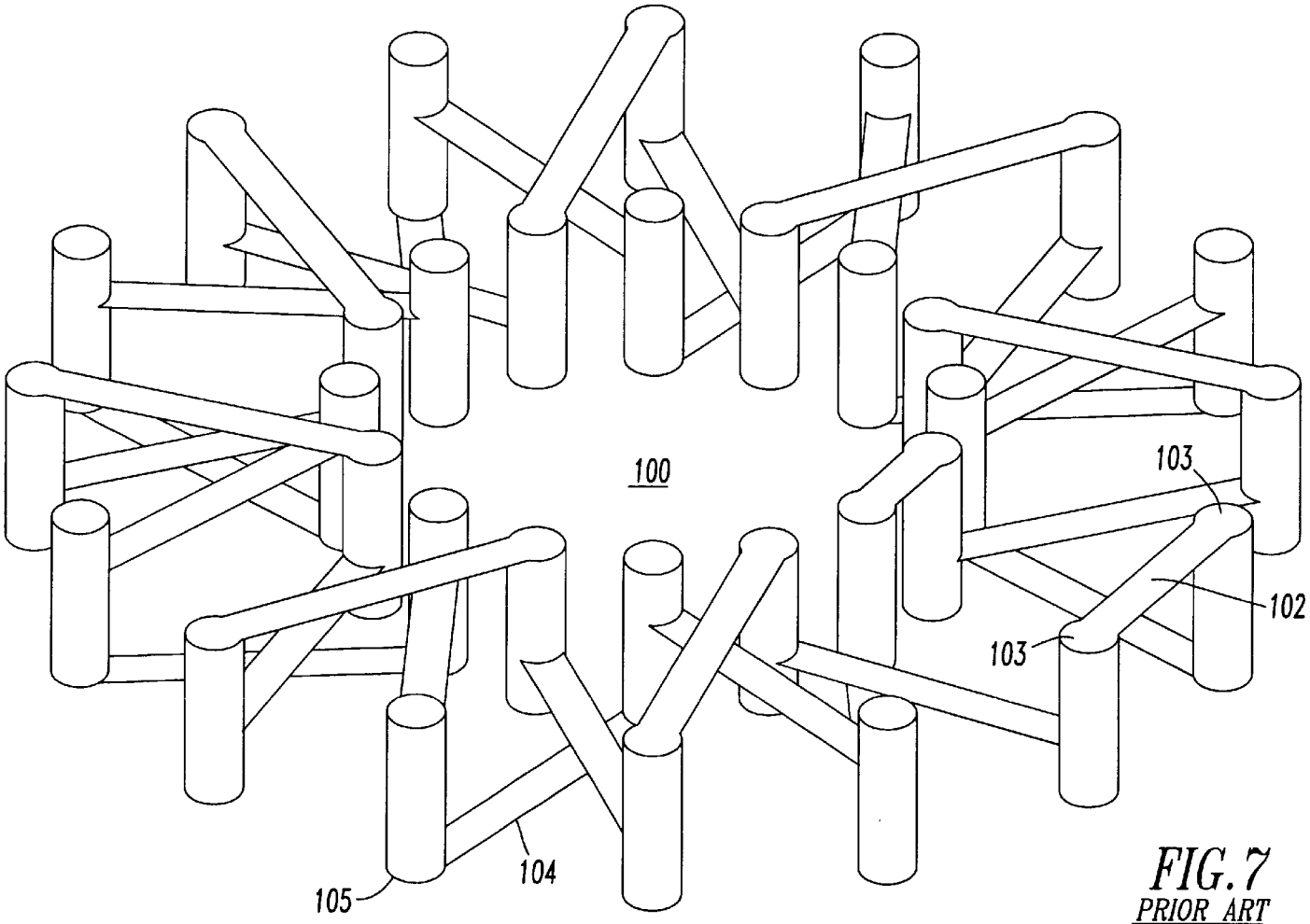
FIG. 7 PRIOR ART
FIG. 7 shows a three-dimensional "x-ray" view of a PCBCTHA.

A shadowy representation of a PCBCTHA 100, which is similar to the PCBCTHA 80 of FIG. 6, is shown in FIG. 7, almost as if it had been x-rayed. From this view, the three-dimensional construction of the CTHA becomes more apparent. Although it is clear that some traces, such as 102, are near the tops of the holes 103 and some traces, such as 104, are near the bottoms of the holes 105, FIG. 7 provides a clearer understanding of which trace is above which other trace in the vicinity of the crossovers. In FIGS. 6 and 7, the feed element (e.g., RF feed 88 of FIG. 6) is placed on top level 81 (level 1) to facilitate electrical connection, although any other level may be employed. The PCBCTHAs disclosed herein are not confined to this feed configuration, but can instead utilize up to 35 different feeds, including inductive or electrostatic couplers, as discussed above. See, also, U.S. patent application Ser. No. 09/639,361, now U.S. Pat. No. 6,437,751 which is incorporated by reference herein.

There are two compromises in CTHA construction that could be alleviated by alterations in printed circuit board manufacturing techniques. The first is the straight through (i.e., perpendicular to the surface nature) of the holes, such as 86 of FIG. 6. The second is the formation of stubs, such as 110,112 of FIG. 8, by utilizing holes 114,116, which traverse all three dielectric material levels 118,120,122 (i.e., of the two double-sided PCBs 72,74 and the spacer board 76).

The conventional toroidal helix has a linear relationship between distance traveled along the helix and angular position about the central axis quantified as θ, although this linear relationship is not required. For the length of the vertical holes in a PCBCTHA (e.g., through holes 86 of PCBCTHA 80), there is no travel in the θ direction. Alternatively, a different manufacturing process (e.g., angled drilling with respect to the plane of the PCB) accommodates holes angled in the direction of θ, in order to provide such travel in the θ direction. A toroidal helix employing such angled holes may, thus, have an improved toroidal magnetic flux core. Economics, however, may favor straight through holes.

Figure 8:
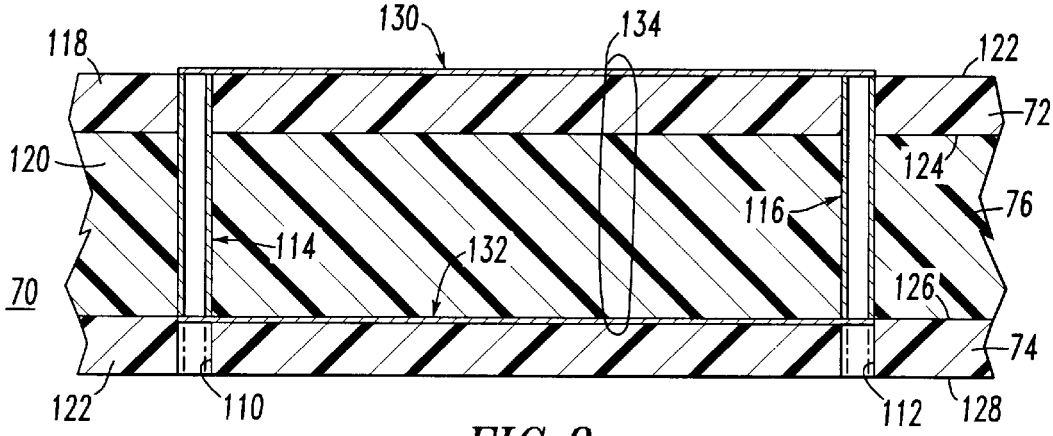
FIG. 8 is a cross-sectional view of a four-layer PCBCTHA including two stubs associated with corresponding through holes.

FIG. 8 shows that the plated through holes 114,116 in the two assembled double-sided printed circuit boards 72,74 and the spacer board 76 create "extra" stubs 110,112 (shown in phantom line drawing). In this context, "extra" is indicative of a conductive section, which is not required to construct the contrawound toroidal helical geometry. It is believed that such stubs 110,112 only minimally affect the performance of the PCBCTHA 70. Nevertheless, elimination of such stubs may be accomplished in several manners. For example, suitable registration between the four conductive levels 122,124,126,128 permits each board 72,74,76 to be drilled separately followed by plating the inside of the through holes 114,116 for the boards 72,76 without plating and/or drilling such holes (not shown) for the board 74. Another example is to construct the PCB 70, as shown, and then with a larger bit (not shown), selectively drill out only the stub portions 110,112. It will be appreciated that other "extra" stub portions (not shown) will be in both of the boards 72,74.

Referring to FIGS. 8 and 9, conductive traces 130 and 132 for a portion of the first contrawound helical winding 134 are only on respective levels 122 (level 1) and 126 (level 3). The corresponding portion of the second contrawound helical winding 136 (shown in FIG. 9) has conductive traces 138 and 140 on respective levels 124 (level 2) and 128 (level 4).

One of the traditional techniques for wrapping a CTHA about a toroidal core form is to weave the conductors in order that the helices are not predisposed by being spatially offset from the other, and to keep the two conductor lengths the same. The PCBCTHA 70 of FIG. 9 is constructed in a similar (displaced but not intertwined) manner. The first helix 134 follows the sequential level path of 1, 3, 2, 4 (levels 122,126,124,128), while the second helix 136 follows the sequential level path of 2, 4, 1, 3 (levels 124,128, 122,126) at the same portion of the PCBCTHA 70. It is believed that the PCBCTHA 70 provides a relatively more symmetric radiation pattern than that of the PCBCTHA 80 of FIG. 6. On the horizon, the radiation pattern would be relatively the same. It is further believed that any differences exist in the near field.

An antenna can be thought of as a distributed circuit with capacitance and inductance. Throughout the spectrum, there are points where the capacitance and inductance are in balance and at these points the antenna is said to resonate. The PCBCTHA offers unique opportunities for the antenna designer to vary antenna parameters that strongly influence the capacitance and inductance of the structure and, hence, affect the resonance points. The dielectric constant of the printed circuit board material strongly and directly affects the capacitance of the structure. Increasing the dielectric constant by suitable selection of the printed circuit board or spacer board material (e.g., fiberglass; any suitable flexible magnetic material; any suitable flexible dielectric material; any suitable dielectric material; any suitable magnetic material) may be employed to adjust resonance points. Relatively higher dielectric constants also decrease the efficiency of the antenna through near field losses in the dielectric. A higher dielectric constant increases losses because higher field strengths are now present in the relatively lossy material (i.e., the loss tangent of the material is not zero). If the material was a nearly perfect lossless dielectric, then increasing the dielectric coefficient would not result in significantly higher losses (i.e., decreased efficiency). However, some applications may warrant a trade-off in size or antenna matching difficulty for efficiency.

Figure 10:
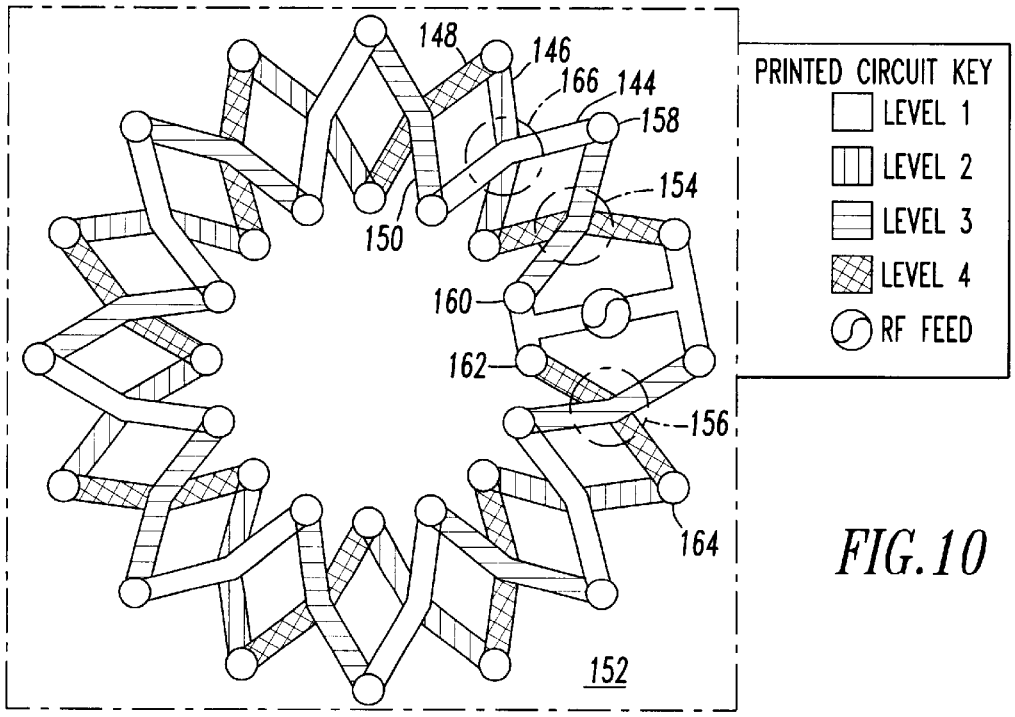
FIG. 10 is a plan view of a bent trace PCBCTHA.

By bending the traces 144,146,148,150, as shown with the PCBCTHA 152 of FIG. 10, two effects are achieved: (1) the crossovers, such as 154,156, are moved to a more central location between the through holes, such as 158,160,162, 164; and (2) the angle between the traces at the crossovers is affected. Since the angle strongly affects the mutual impedance of the two traces in the vicinity of the crossovers this provides an important design consideration. For example, traces, such as 144,146, which are orthogonal to each other at the crossover 166, should have minimal coupling therebetween. It will be appreciated that a similar result may be achieved by employing somewhat arcuate traces which are at least substantially orthogonal at the crossover.

Figure 11:
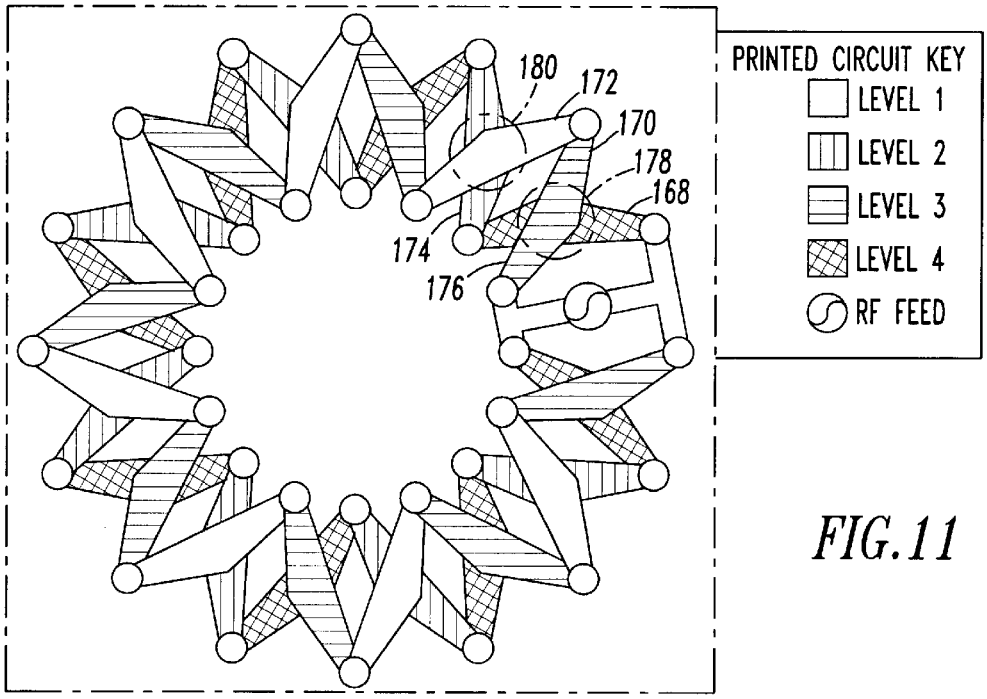
FIG. 11 is a plan view of a fat trace PCBCTHA.

Another parameter that most directly affects the capacitance is the trace width. This is especially pronounced in the vicinity of the crossovers. FIG. 11 shows an increase of the width of the traces 168,170,172,174 in the vicinity of the crossovers 178,180, which will greatly increase the capacitance. For example, each set of traces, which constitutes a crossover, includes two planar surfaces, which are separated by a dielectric (i.e., forming a capacitor).

The PCBCTHA 70 of FIG. 9 shows two interwoven helices. The PCBCTHA 152 of FIG. 10 shows two displaced helices.

By varying the thickness of the PCB insulator (e.g., 76 of FIG. 8) or the thickness of the double-sided boards (e.g., 72,74 of FIG. 8) and, thus the length of the feedthroughs 114,116, a more vertically (e.g., if relatively taller) or horizontally (e.g., if relatively shorter) polarized gain in the azimuth plane is provided.

Figure 12:
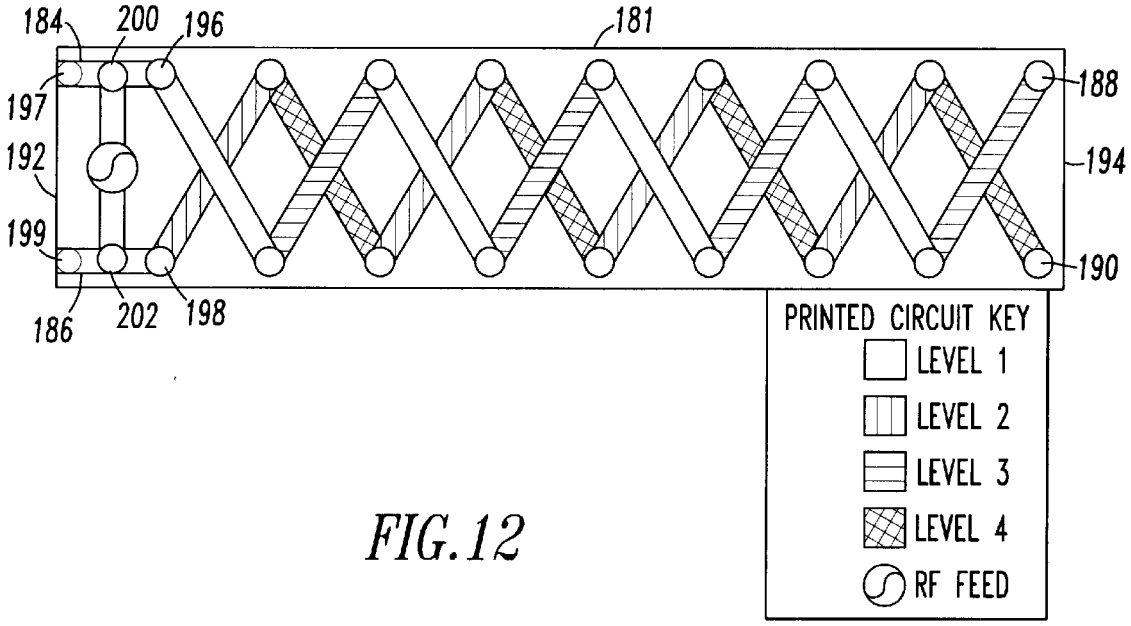
FIG. 12 is a plan view of a flexible PCB antenna in accordance with an embodiment of the invention.
Figure 13:
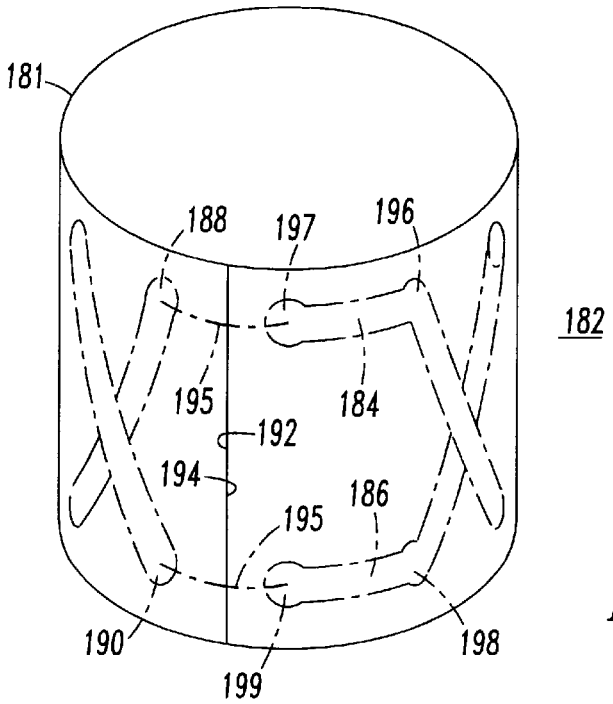
FIG. 13 is an isometric view of a cylindrical PCB antenna formed from the flexible PCB antenna of FIG. 12.

The use of flexible printed circuit board materials 181 (e.g., in place of the more rigid boards 72,74,76 of FIG. 8) makes possible cylindrical antenna structures, such as antenna 182 of FIG. 13, wherein printed crossover traces 184,186 and through holes 188,190 are on the ends 192,194 as shown in FIG. 12. The resulting antenna 182 is manufactured by forming the printed circuit board materials (e.g., three, four, five or more levels) 181 into a cylinder and electrically connecting (e.g., with suitable conductors, such as wire jumpers 195) through hole 197 of the trace 184 with the through hole 188, and through hole 199 of the trace 186 with the through hole 190. It is believed that the antenna 182 provides a relatively lightweight, possibly portable, package. The antenna 182 provides relatively less magnetic field and relatively more electric field, similar to a loop, but because of the length of the traces, it resonates at a lower frequency. For example, the flexible printed circuit board materials 181 of FIG. 12 may readily be mounted on a structure such as a telephone pole or other cylindrical structure in a flush surface manner.

In the antenna 182 of FIGS. 12 and 13, four nodes are defined by the through holes 196,188,198,190. A first node (through hole 196) is electrically connected to a second node (through hole 188), and a third node (through hole 198) is electrically connected to a fourth node (through hole 190) in order that the two helices form two endless conductive paths. There is a first electrical connection 184 from a first signal terminal 200 to the through hole 196, and a second electrical connection 186 from a second signal terminal 202 to the through hole 198. The terminals 200,202 form the feed port of the antenna 182.

Figure 14:
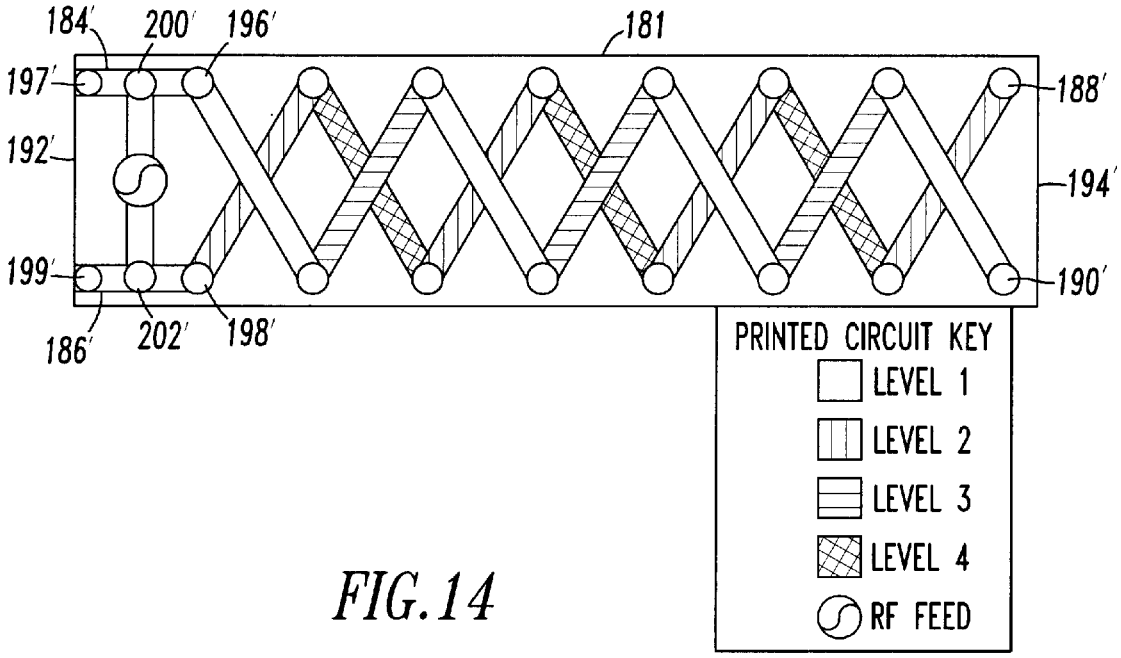
FIG. 14 is a plan view of a flexible PCB antenna in accordance with another embodiment of the invention.
Figure 15:
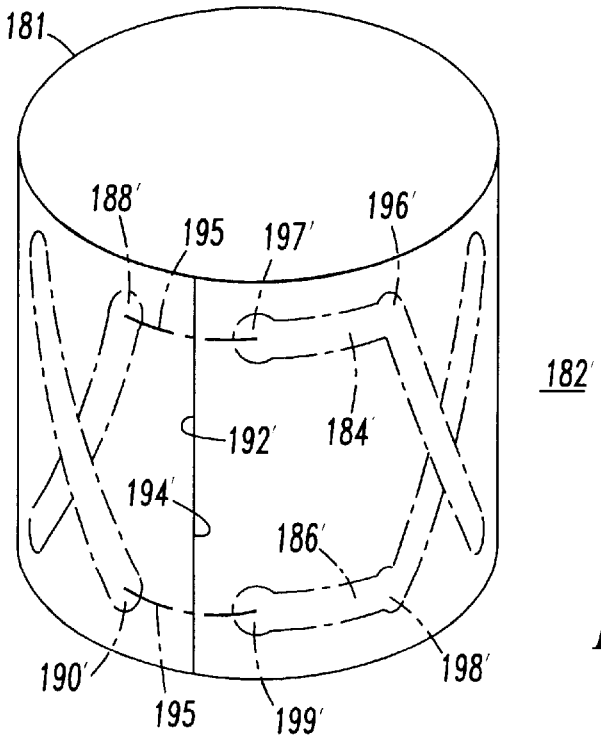
FIG. 15 is an isometric view of a cylindrical PCB antenna formed from the flexible PCB antenna of FIG. 14.

FIG. 14 shows another use of the flexible printed circuit board materials 181 to form the antenna 182' of FIG. 15, wherein printed crossover traces 184',186' and through holes 188',190' are on the respective ends 192',194' as shown in FIG. 14. The resulting antenna 182' is manufactured by forming the printed circuit board materials 181 into a cylinder and electrically connecting (e.g., with suitable conductors, such as wire jumpers 195') through hole 197' of the trace 184' with the through hole 188', and through hole 199' of the trace 186' with the through hole 190'. It is believed that the antenna 182' provides a relatively lightweight, possibly portable, package, and provides a different and, thus, potentially advantageous polarization pattern with respect to the antenna 182 of FIG. 13.

In the antenna 182' of FIGS. 14 and 15, four nodes are defined by the through holes 196',190',198',188'. A first node (through hole 196') is electrically connected to a fourth node (through hole 188'), and a second node (through hole 190') is electrically connected to a third node (through hole 198') in order that the two helices form a single endless conductive path. There is a first electrical connection 184' from a first signal terminal 200' to the through hole 196', and a second electrical connection 186' from a second signal terminal 202' to the through hole 198'.

Figure 16:
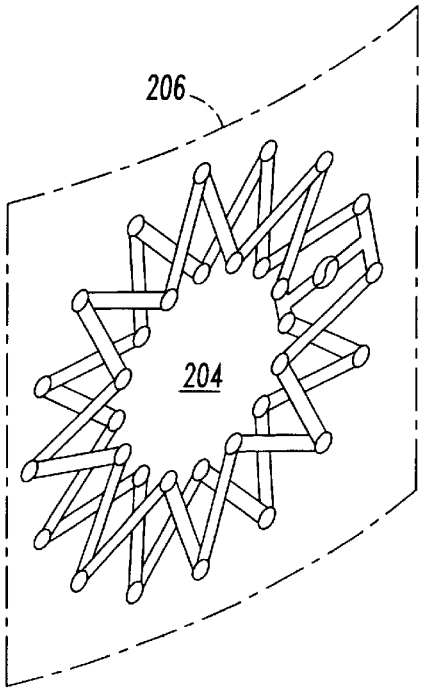
FIG. 16 is an isometric view of a flexible PCB antenna in accordance with another embodiment of the invention.
Figure 17:
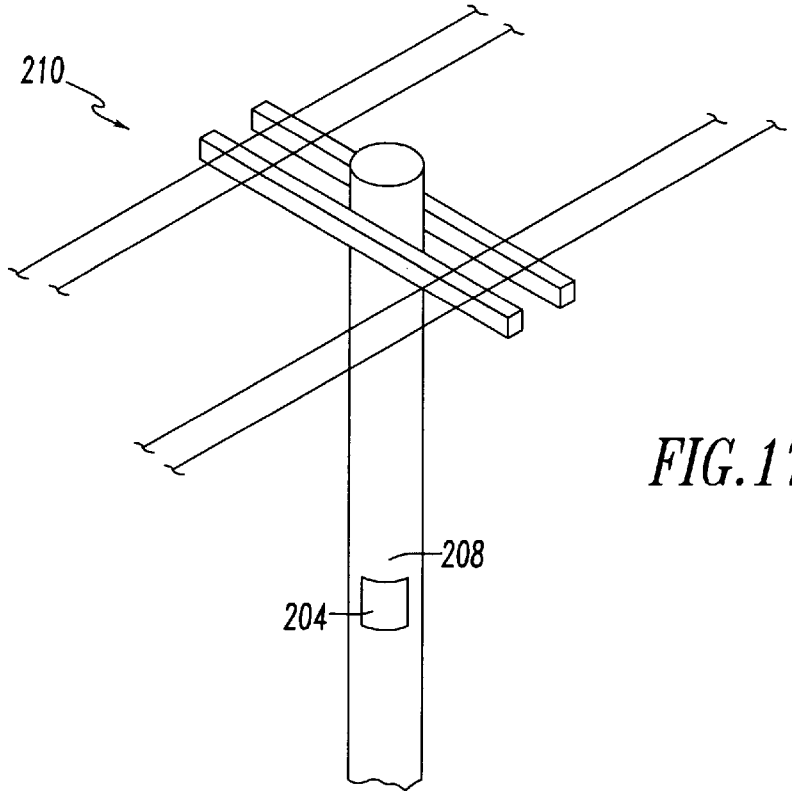
FIG. 17 is an isometric view of the flexible PCB antenna of FIG. 16, which has been conformed to a non-planar surface.

FIG. 16 shows a flexible PCB antenna 204, which is similar to the PCBCTHA antennas of FIGS. 6–11, except that the flexible PCB antenna 204 has a flexible printed circuit board 206 made of a suitable flexible material. Although a partial cylindrical shape is shown, a wide range of simple shapes (e.g., concave, convex) and complex shapes may be employed. As shown in FIG. 17, the flexible PCB antenna 204 is adapted to conform to a non-planar surface, such as the surface 208 a telephone pole 210, by being partially or completely wrapped around and suitably secured (e.g., by glue, suitable fasteners, Velcro™) to that structure. Although a particular feed connection is shown in FIG. 6, a wide range of feed connections may be employed as discussed, above, in connection with Table 2.

Figure 18:
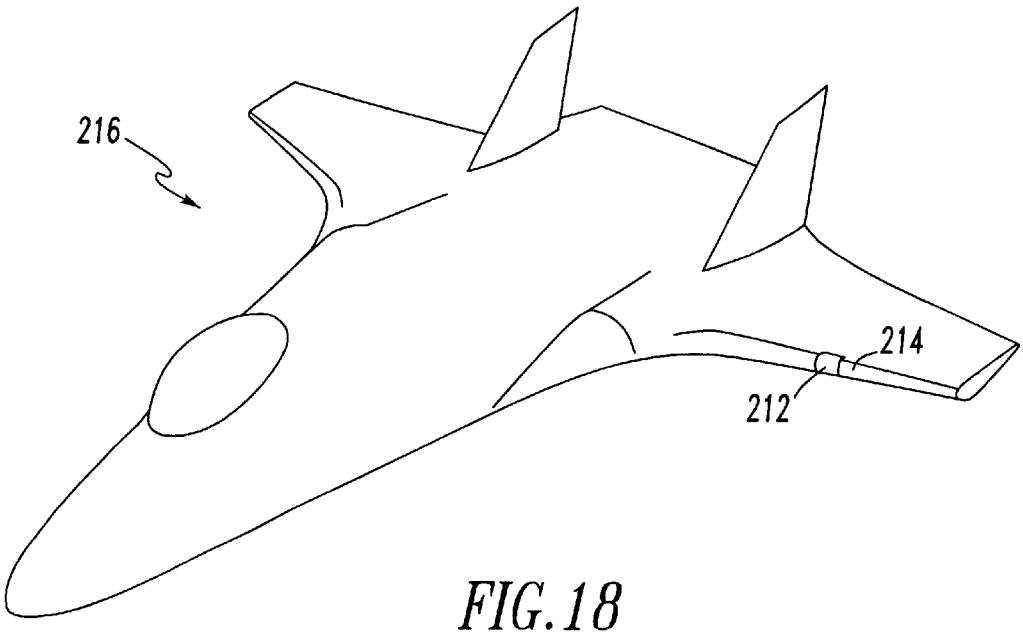
FIG. 18 is an isometric view of the flexible PCB antenna of FIG. 16, which has been conformed to a surface of an aircraft.

FIG. 18 shows a flexible PCB antenna 212, which is similar to the flexible PCBCTHA antenna 204 of FIG. 16. The antenna 212 has been conformed by shrink-wrapping to partially wrap about the surface 214 (e.g., made of any suitable material, such as metals, alloys, and/or composites) of an aircraft 216.

Figure 19:
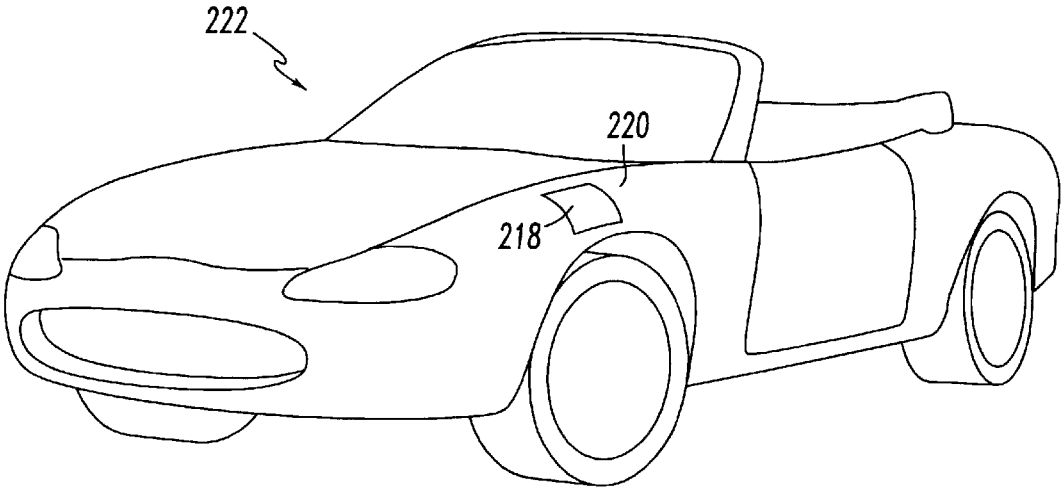
FIG. 19 is an isometric view of the flexible PCB antenna of FIG. 16, which has been conformed to a surface of a vehicle.

FIG. 19 shows a flexible PCB antenna 218, which is similar to the flexible PCBCTHA antenna 204 of FIG. 16. The antenna 218 has been conformed and attached (e.g., by glue, suitable fasteners, Velcro™) to a surface 220 of a vehicle, such as an automobile 222.

Figure 20:
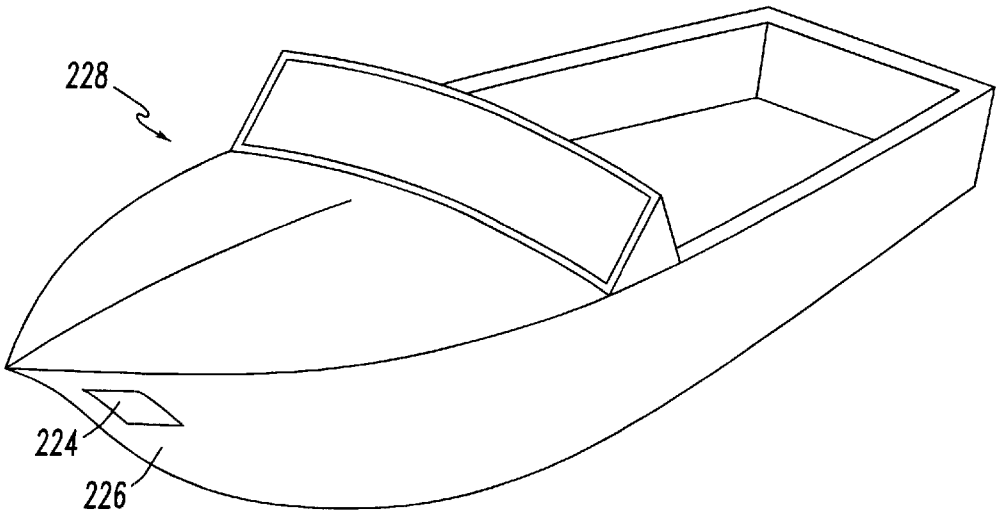
FIG. 20 is an isometric view of the flexible PCB antenna of FIG. 16, which has been conformed to a surface of a water vessel.

FIG. 20 shows a flexible PCB antenna 224, which is similar to the flexible PCBCTHA antenna 204 of FIG. 16. The antenna 224 has been conformed and attached to a surface 226 of a water vessel 228.

Figure 22:
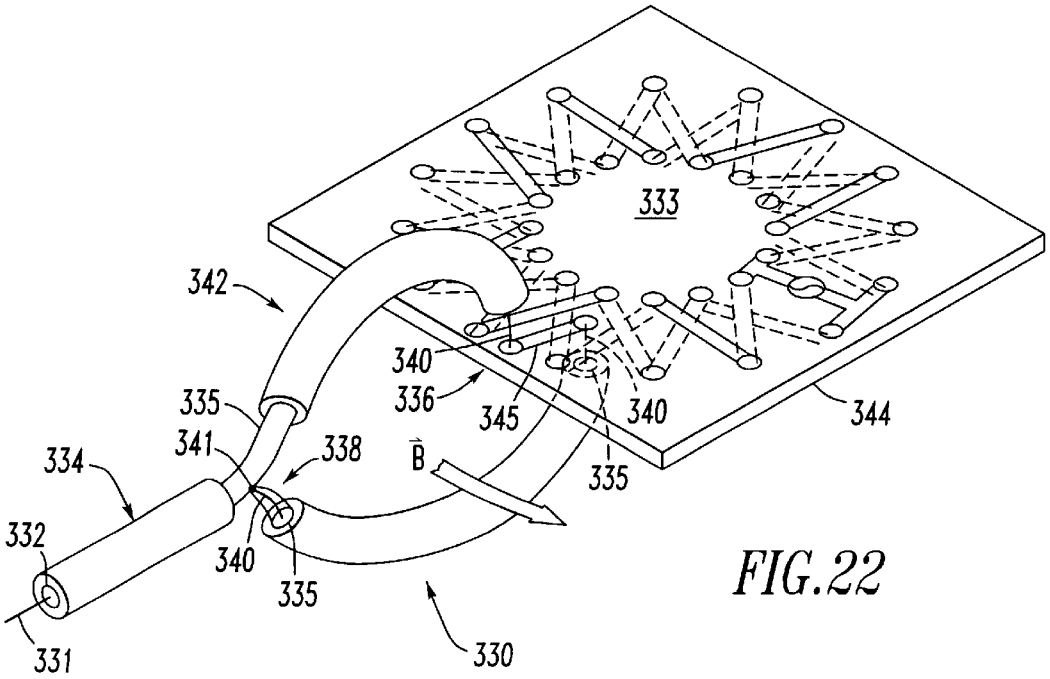
FIG. 22 is a block diagram in schematic form of an electromagnetic antenna in which the antenna signal is inductively or magnetically coupled to the contrawound insulated conductors of a PCBCTHA.

FIG. 22 shows an example of a conventional shielded loop 330 which is employed to magnetically couple an RF signal at signal carrying terminals 331,332 to or from a PCBCTHA antenna 333. The exemplary shielded loop 330 is formed by a coaxial cable 334 (e.g., 50 Ω), in which the shield 335 is cut at 336 and 338 to expose the center conductor 340. In turn, the center conductor 340 and the corresponding shield 335 are electrically connected to the exposed shield 335 at 341. The exposed center conductor 340 (or cut shield) at 336 serves to stop the current flow in the shield 335. Although no electrical connection is made from the coupling loop 342 to the antenna 333, the loop 342 is suitably positioned in proximity to the PCBCTHA 333, and preferably without passing completely around the pseudo-toroidal surface, in order to couple and match RF energy to or from the antenna 333. Preferably, the size of the loop 342 is relatively small with respect to the wavelength, λ, of the RF signal at terminals 331,332.

In the exemplary embodiment, the exposed center conductor 340 (or cut shield) at 336 is preferably electrically connected in series with one or more printed circuit traces (not shown) of the PCB 344, with such traces being suitably proximate one or more of the traces, such as 345 of the PCBCTHA 333, for a suitable distance, in order to promote suitable capacitive or inductive coupling between the loop 342 and the PCBCTHA 333. Alternatively, the conductor 340 is laid parallel (not shown) to a length of one or more of such traces in order to suitably couple the antenna signal.

In applications in which three of the nodes, such as B,C,D (see, for example, Table 2 and FIG. 2B), of the PCBCTHAs are open, one of the signal terminals may be electrically connected to the other node, such as node A, with the other signal terminal being structured for connection to a cooperative antenna structure (not shown) such as, for example, a ground plane, a reflector, or any other antenna structure.

The present invention is also applicable to capacitive feed arrangements (not shown) in which an antenna signal is capacitively coupled to the contrawound helices of a PCBCTHA by a suitable capacitive coupling circuit.

The present invention is further applicable to a passive PCBCTHA (not shown) in which signal terminals provide antenna coupling of the passive PCBCTHA in an array with an active dipole or in an array with an active CTHA or other PCBCTHA.

By employing flexible printed circuit board materials (e.g., without limitation, dielectric, magnetic), a wide range of PCBCTHA configurations are possible. For example, a flexible PCBCTHA may readily be fit to the planar or non-planar side of a structure. In this manner, for example, aircraft, vehicles and water vessels can gain an antenna without sacrificing aerodynamics or hydrodynamics. The actual antenna may take the form of a decal affixed to the planar or non-planar body of a vehicle. The antenna could also become part of a body panel (e.g., manufactured right into the wing of an aircraft). Therefore, the flexible PCBCTHA may be suitably disposed on a wide range of surfaces (e.g., on a non-planar surface, such as an arcuate surface, the surface of an airplane wing, the surface of the hull of a boat or ship, the surface of a vehicle (e.g., car, bus, train), the surface of a cone, the surface of a wedge, the surface of a sphere, the exterior or interior surface or printed circuit board of an electronic device, such as, for example, a cellular telephone, other hand-held electronic device); may be suitably attached (e.g., by a suitable adhesive) to the surface; may be suitably conformed (e.g., folded, bent, shrink fit) to the surface; and may be partially or completely wrapped around a closed surface, such as the surface of a telephone pole.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electromagnetic antenna for a non-planar surface, said electromagnetic antenna comprising:

a flexible printed circuit board having at least three conductive levels, said flexible printed circuit board being adapted to conform to said non-planar surface, said flexible printed circuit board including a plurality of electrical connections between said conductive levels and a plurality of electrical traces on said conductive levels, said electrical connections and said electrical traces forming a first helix having a first helical pitch sense from a first node to a second node, and also forming a second helix having a second helical pitch sense, which is opposite from the first helical pitch sense, from a third node to a fourth node, said first and second helices being contrawound relative to each other;

first and second signal terminals; and means for electrically connecting said signal terminals with at least one of said nodes.

2. The electromagnetic antenna as recited in claim 1, wherein said first node is electrically connected to said fourth node and said second node is electrically connected to said third node in order that the first and second helices form a single endless conductive path; and wherein said means for electrically connecting includes a first electrical connection from the first signal terminal to the first node, and a second electrical connection from the second signal terminal to the third node.

3. The electromagnetic antenna as recited in claim 1, wherein sad first node is electrically connected to said second node and said third node is electrically connected to said fourth node in order that the first and second helices form two endless conductive paths; and wherein said means for electrically connecting includes a first electrical connection from the first signal terminal to the first node, and a second electrical connection from the second signal terminal to the third node.

4. The electromagnetic antenna as recited in claim 1, wherein said flexible printed circuit board is adapted to conform to a surface of an aircraft as said non-planar surface.

5. The electromagnetic antenna as recited in claim 1, wherein said flexible printed circuit board is adapted to conform to a surface of a vehicle as said non-planar surface.

6. The electromagnetic antenna as recited in claim 1, wherein said flexible printed circuit board is adapted to conform to a surface of a water vessel as said non-planar surface.

7. The electromagnetic antenna as recited in claim 1, wherein said flexible printed circuit board is adapted to conform to an arcuate surface as said non-planar surface.

8. The electromagnetic antenna as recited in claim 1, wherein said flexible printed circuit board is adapted for attachment to said non-planar surface.

9. The electromagnetic antenna as recited in claim 1, wherein said flexible printed circuit board is adapted for partial wrapping about a closed surface as said non-planar surface.

10. The electromagnetic antenna as recited in claim 1, wherein said flexible printed circuit board is adapted for complete wrapping about a closed surface as said non-planar surface.

11. The electromagnetic antenna of claim 1 wherein said flexible printed circuit board includes a first flexible printed circuit board having first and second conductive levels, a second flexible printed circuit board having third and fourth conductive levels, and a flexible spacer board between said first and second flexible printed circuit boards, said first, second, third and fourth conductive levels forming said conductive levels of said flexible printed circuit board.

12. The electromagnetic antenna of claim 11 wherein said first and second flexible printed circuit boards have a first thickness; and wherein said flexible spacer board has a second thickness which is greater than said first thickness.

13. The electromagnetic antenna of claim 11 wherein said second and third conductive levels are proximate said flexible spacer board; and wherein said first and second terminals are electrically connected to said first and fourth conductive levels.

14. The electromagnetic antenna of claim 1 wherein said non-planar surface has a major axis; wherein the electrical connections of said flexible printed circuit board are a plurality of through holes between said conductive levels; and wherein a normal to said major axis passes through said through holes.

15. The electromagnetic antenna of claim 1 wherein said non-planar surface has a major axis; wherein the electrical connections of said flexible printed circuit board are a plurality of through holes between said conductive levels; wherein the through holes of at least some of said conductive levels form a plurality of linear channels through at least some of said flexible printed circuit board; wherein a normal to said major axis passes through one of said through holes on at least some of said levels; and wherein the linear channel of said one of said through holes is oriented at an angle with respect to said normal.

16. The electromagnetic antenna of claim 1 wherein the electrical connections of said flexible printed circuit board are a plurality of through holes between said conductive levels; wherein one of the through holes on each of said levels forms a conductive channel through said flexible printed circuit board; wherein said channel forms a portion of one of the first and second helices; and wherein said conductive channel includes a stub having a first end, which is electrically connected to said one of the first and second helices, and a second end.

17. The electromagnetic antenna of claim 1 wherein the electrical connections of said flexible printed circuit board are a plurality of through holes between said conductive levels; wherein one of the through holes on each of said levels forms a conductive channel through at least two of said conductive levels of said flexible printed circuit board; wherein said channel forms a portion of one of the first and second helices; and wherein said conductive channel has a first end, which is electrically connected to one of the first and second helices, and a second end, which is electrically connected to the other of said first and second helices.

18. The electromagnetic antenna of claim 1 wherein the electrical connections of said flexible printed circuit board are a plurality of through holes between said conductive levels; and wherein said through holes have an opening therein.

19. The electromagnetic antenna of claim 1 wherein the electrical connections of said flexible printed circuit board are a plurality of through holes between said conductive levels; and wherein said through holes have solder therein.

20. The electromagnetic antenna of claim 1 wherein a first one of the conductive traces on one of said conductive levels crosses over a second one of the conductive traces on another one of said conductive levels; and wherein said first and second conductive traces are linear.

21. The electromagnetic antenna of claim 1 wherein a first one of the conductive traces on one of said conductive levels crosses over a second one of the conductive traces on another one of said conductive levels at a crossover; and wherein said first and second conductive traces have bends at the crossover.

22. The electromagnetic antenna of claim 21 wherein the electrical connections of said flexible printed circuit board include first, second, third and fourth through holes between said conductive levels; wherein the first conductive trace has first and second ends which are electrically connected to the first and second through holes, respectively; wherein the second conductive trace has first and second ends which are electrically connected to the third and fourth through holes, respectively; wherein the first, second, third and fourth through holes define an area having a center; and wherein said crossover is located at said center.

23. The electromagnetic antenna of claim 21 wherein the first and second conductive traces are orthogonal to each other at the crossover.

24. The electromagnetic antenna of claim 21 wherein the first and second conductive traces have a first width at the first ends thereof, a second width at the crossover, and a third width at the third ends thereof; and wherein said second width is greater than said first width and said third width.

25. The electromagnetic antenna of claim 11 wherein said first helix includes a plurality of said conductive traces which follow a first sequential helical path from said first conductive level to said third conductive level to said second conductive level to said fourth conductive level; and wherein said second helix includes a plurality of said conductive traces which follow a second sequential helical path from said second conductive level to said fourth conductive level to said first conductive level to said third conductive level.

26. The electromagnetic antenna of claim 25 wherein said first helix includes a plurality of said first sequential helical paths from said first node to said second node; and wherein said second helix includes a plurality of said second sequential helical paths from said third node to said fourth node.

27. The electromagnetic antenna of claim 26 wherein said first node is electrically connected to a first conductor on said first conductive level and to a first conductive trace of a first one of the first sequential helical paths on said first conductive level; and wherein said third node is electrically connected to a second conductor on said first conductive level and to a first conductive trace of a first one of the second sequential helical paths on said second conductive level.

28. The electromagnetic antenna of claim 27 wherein said first conductor electrically connects said first node and said fourth node; wherein said second conductor electrically connects said second node and said third node in order that the first and second helices form a single endless conductive path.

29. An electromagnetic antenna comprising:

a flexible printed circuit board having at least three conductive levels, a first end and a second end, said first end being positioned proximate said second end to form a non-planar surface, said flexible printed circuit board including a plurality of electrical connections between said conductive levels and a plurality of electrical traces on said conductive levels, said electrical connections and said electrical traces forming a first helix having a first helical pitch sense from a first node to a second node, and also forming a second helix having a second helical pitch sense, which is opposite from the first helical pitch sense, from a third node to a fourth node, said first and second helices being contrawound relative to each other;

first and second signal terminals; and means for electrically connecting said signal terminals with at least one of said nodes.

30. The electromagnetic antenna as recited in claim 29, wherein said first node is electrically connected to said fourth node and said second node is electrically connected to said third node in order that the first and second helices form a single endless conductive path; and wherein said means for electrically connecting includes a first electrical connection from the first signal terminal to the first node, and a second electrical connection from the second signal terminal to the third node.

31. The electromagnetic antenna as recited in claim 29, wherein said first node is electrically connected to said second node and said third node is electrically connected to said fourth node in order that the first and second helices form two endless conductive paths; and wherein said means for electrically connecting includes a first electrical connection from the first signal terminal to the first node, and a second electrical connection from the second signal terminal to the third node.

32. The electromagnetic antenna of claim 29 wherein said non-planar surface is a cylinder.

33. The electromagnetic antenna of claim 29 wherein said first node is electrically connected to a first conductor on one of said conductive levels; wherein said third node is electrically connected to a second conductor on one of said conductive levels; wherein said first and second conductors, said first node and said third node are proximate the first end of said flexible printed circuit board; wherein said second node and said fourth node are proximate the second end of said flexible printed circuit board; and wherein said flexible printed circuit board is bent to form a cylinder.

34. The electromagnetic antenna of claim 29 wherein said first node is electrically connected to a first conductor on one of said conductive levels; wherein said third node is electrically connected to a second conductor on one of said conductive levels; wherein said first conductor electrically connects said first node and said second node; and wherein said second conductor electrically connects said third node and said fourth node in order that the first and second helices form two endless conductive paths.

35. The electromagnetic antenna of claim 34 wherein said first and second conductors, said first node and said third node are proximate the first end of said flexible printed circuit board; wherein said second node and said fourth node are proximate the second end of said flexible printed circuit board; and wherein said flexible printed circuit board is bent to form a cylinder.

36. An electromagnetic antenna for a non-planar surface, said electromagnetic antenna comprising:

a flexible printed circuit board having at least three conductive levels, said flexible printed circuit board being adapted to conform to said non-planar surface, said flexible printed circuit board including a plurality of electrical connections between said conductive levels and a plurality of electrical traces on said conductive levels, said electrical connections and said electrical traces forming a first helix having a first helical pitch sense from a first node to a second node, and also forming a second helix having a second helical pitch sense, which is opposite from the first helical pitch sense, from a third node to a fourth node, said first and second helices being contrawound relative to each other;

first and second signal terminals structured for transmitting or receiving an antenna signal; and means for electrically coupling said antenna signal to or from said first and second helices.

37. The electromagnetic antenna of claim 36 wherein said means for electrically coupling is a shielded loop.

38. An electromagnetic antenna comprising:

a flexible printed circuit board having at least three conductive levels, a first end and a second end, said first end being positioned proximate said second end to form a non-planar surface, said flexible printed circuit board including a plurality of electrical connections between said conductive levels and a plurality of electrical traces on said conductive levels, said electrical connections and said electrical traces forming a first helix having a first helical pitch sense from a first node to a second node, and also forming a second helix having a second helical pitch sense, which is opposite from the first helical pitch sense, from a third node to a fourth node, said first and second helices being contrawound relative to each other;

first and second signal terminals structured for transmitting or receiving an antenna signal; and means for electrically coupling said antenna signal to or from said first and second helices.

* * * * *